US008746016B2

(12) United States Patent
Junior et al.

(10) Patent No.: US 8,746,016 B2
(45) Date of Patent: Jun. 10, 2014

(54) SUSPENSION SYSTEM FOR WASHING MACHINES

(75) Inventors: Alvaro Volpato Junior, Curitiba (BR); Antonio Fernando Da Cunha, Curitiba (BR); Felipe Augusto Scheer, Curitiba (BR)

(73) Assignee: Electrolux do Brasil SA, Curitiba PR (BR)

( * ) Notice: Subject to any disclaimer, the term of this patent is extended or adjusted under 35 U.S.C. 154(b) by 919 days.

(21) Appl. No.: 12/845,542

(22) Filed: Jul. 28, 2010

(65) Prior Publication Data

US 2011/0023556 A1 Feb. 3, 2011

(30) Foreign Application Priority Data

Jul. 29, 2009 (BR) ..... 0902530

(51) Int. Cl.
*D06F 37/20* (2006.01)

(52) U.S. Cl.
USPC ..... 68/23.2; 68/140

(58) Field of Classification Search
CPC ..... D06F 21/08; D06F 37/24; D06F 37/268; D06F 2222/00
USPC ..... 68/23.1, 23.2, 140
See application file for complete search history.

(56) References Cited

U.S. PATENT DOCUMENTS

| | | | | | |
|---|---|---|---|---|---|
| 1,740,938 | A | * | 12/1929 | Altorfer | 68/133 |
| 2,375,635 | A | * | 5/1945 | Dyer | 74/572.4 |
| 2,745,273 | A | * | 5/1956 | Archbold | 68/23.2 |
| 2,863,311 | A | * | 12/1958 | Brucken | 68/12.01 |
| 2,995,918 | A | * | 8/1961 | Neidenthal et al. | 68/23.1 |
| 3,527,904 | A | * | 9/1970 | Worst | 200/61.45 R |
| 3,939,674 | A | | 2/1976 | Czech et al. | |
| 3,952,557 | A | * | 4/1976 | Bochan | 68/23.3 |
| 5,657,649 | A | * | 8/1997 | Lim | 68/23.3 |
| 6,557,383 | B1 | * | 5/2003 | Ito et al. | 68/23.2 |
| 2007/0251278 | A1 | | 11/2007 | Barcha et al. | |
| 2007/0289339 | A1 | | 12/2007 | Lim | |
| 2008/0289368 | A1 | * | 11/2008 | Braz et al. | 68/13 R |
| 2011/0277514 | A1 | * | 11/2011 | Kim et al. | 68/23.2 |

FOREIGN PATENT DOCUMENTS

| | | | |
|---|---|---|---|
| BR | PI0601707 | A | 12/2007 |
| BR | MU8700407-0 | U | 10/2008 |
| DE | 102007026130 | A1 | 12/2007 |
| WO | 97/45582 | A1 | 12/1997 |
| WO | 2008/056953 | A1 | 5/2008 |

* cited by examiner

*Primary Examiner* — Joseph L Perrin
(74) *Attorney, Agent, or Firm* — Banner & Witcoff, Ltd.

(57) ABSTRACT

A suspension (1) of a washing machine has a mechanical assembly resting on the bottom of the cabinet (3) by means of a lower cushion including plates (5 and 7) and shock absorbers (6) and a liquid containing casing (4). The suspension system (1) is intended to absorb the movement of the mechanical (wash group) assembly during a centrifugal spin, reducing the transmissibility of forces/movements to the external cabinet (3), while the liquid containing casing provides a cost-effective counterbalance within the system.

20 Claims, 4 Drawing Sheets

SUSPENSION SYSTEM FOR WASHING MACHINES

CROSS REFERENCE TO RELATED APPLICATION

This application claims priority from Brazilian Patent Application No. PI0902530-8, filed Jul. 29, 2009, the content of which is hereby incorporated by reference in its entirety.

FIELD OF THE INVENTION

The present invention pertains to the field of mechanical engineering, more specifically, electromechanical devices, commonly known as household appliances, especially washing machines, more specifically a suspension system for washing machines

BACKGROUND

In top loading washing machines, the drive unit is commonly defined by an electric motor coupled to the drive shaft, directly or by means of transmission and fixed upon a support frame that is affixed or incorporated, in one piece, to the external lower side of a lower wall of the tub, wherein the assembly defined by the drive unit, vertical drive shaft and rotary basket remains fixed to the tub, conveying to the latter all the vibrations and oscillations caused by the spin of the basket during the washing and centrifugation operations, particularly when a centrifuge with eccentric masses results from a non-homogeneous distribution of the load of clothes inside the basket. In this common construction, the tub vibrates and oscillates in conjunction with the basket and the drive unit.

In the type of construction described above, the tub defines a structure that cannot be directly supported on the floor, due to the movement to which it is subjected during the machine operation. Thus, the provision of means of suspension that are able to absorb or dissipate at least a portion of the vibrating energy transmitted to the tub is required.

The solution known to circumvent this issue necessarily involves the provision of a cabinet encompassing the tub and the drive motor, the cabinet being supported directly on the floor. This arrangement includes the provision of constructive means of suspension, usually in the form of springs or other elastic elements, mounted on fixed rods, on the one extreme, in the region of the lower wall of the tank and at the other extreme, the upper inner portion of the cabinet.

Despite being widely used, this constructive solution of the prior art requires the provision of a cabinet to operate as a support structure for the remainder of the machine and also as a fixed housing, involving oscillating parts of the machine and operating as a defining element of the aesthetic aspect the machine. Besides being one more element in the construction of such machines, the cabinet leads to an increase in the dimensions of the whole assembly, as it has to internally accommodate the means of suspension, providing a circumferential backlash against the tub, still enough to prevent the latter to conflict with the cabinet during centrifuge operations with an eccentric load of laundry.

In another known solution, the drive motor is fixed to the vertical drive shaft passing through the bottom of the tub and carrying the rotary basket, the drive motor being attached to a support frame which is in turn backed by a base structure seated on the floor, by means of suspension including springs and shock absorbers. In this construction, the tub is mounted on a frame support, passing to oscillate and vibrate together with the basket and the drive motor when the machine is in operation. Although the means of suspension are fitted below the support frame, allowing the structural function of the cabinet to be limited in terms of support frame, the provision of a cabinet with sufficient height to encompass the whole of the tank is required in order to protect it visually and operationally during machine operation, as the tank oscillates and vibrates together with the basket and the drive motor.

Brazilian Patent Application No. PI0601707 (corresponding to U.S. Publication Application No. 2007/0251278) provides a top loading clothing washing machine that includes: a basic structure of a generally tubular form, to be inferiorly supported on a floor, a tank for containing a washing liquid and fixed on the basic structure, a support frame suspended within the basic structure; means of suspension absorbers of vibratory and oscillatory movements and connecting the frame to support the basic structure in order to keep the first suspended inside the last one; a drive motor disposed within the basic structure, fixed to the support frame and carrying a drive shaft extending vertically upward, into the tank and a rotating basket provided inside the tank and operatively and selectively associated with the drive shaft.

BRIEF SUMMARY OF SELECTED INVENTIVE ASPECTS

To circumvent the problems described in the above techniques, provided in an aspect of the invention is a suspension of a washing machine with the mechanical assembly supported on the bottom of the cabinet through a lower suspension including plates and shock absorbers (e.g., spring and dampener assemblies) and a casing containing liquid (e.g., water). Such a configuration is advantageously applied to washing machines with cabinets having a reduced load support capacity in their upper region, originated from the washing set, for example: plastic cabinets, or in cabinets that also serve as a static water tub with an inner rotary basket. The suspension demonstrates an innovation in its design, e.g., in that the washing set (wash group) is supported on the bottom of the cabinet with a bottom suspension including shock absorbers (e.g., spring and dampener assemblies) and a casing containing liquid (e.g., water). The shock absorbers connect a top mobile plate to a bottom fixed part (e.g., plate) of such suspension and the liquid containing casing is mounted on the top mobile plate offset from the drive motor.

In one aspect, the invention comprises a suspension of washing machines with a mechanical assembly resting on the bottom of the cabinet by means of a lower suspension including plates and shock absorbers (e.g., spring dampener assemblies) and a liquid containing casing, as aforesaid. The suspension system is intended to absorb the movement of the mechanical assembly in the centrifuge, reducing the transmissibility of forces/movement to the external cabinet.

The use and correct sizing of the liquid containing casing as a counterbalance to the motor is a cost-effective solution that ensures proper kinematics during the spin cycle for this type of washing machine with a lower support of the washing assembly (wash group). This leads to greater orbits at the top of the basket than at the bottom, thus reducing the lateral movement of the mobile plate of the suspension and the transmission of side forces/movement to the cabinet, therefore minimizing the moving effect of the machine during spin cycles.

This summary is provided to introduce a selection of concepts of the inventive subject matter that are further described below in the detailed description. This summary is not intended to identify essential features or advantages of the claimed subject matter, nor is it intended to be used to limit the scope of the claimed subject matter. Additional features and advantages are further described below.

BRIEF DESCRIPTION OF THE DRAWINGS

Aspects of the invention are illustrated by way of example and not by limitation in the accompanying figures in which like reference numerals indicate similar elements and in which.

DETAILED DESCRIPTION OF EXEMPLARY EMBODIMENTS

Figure 2:
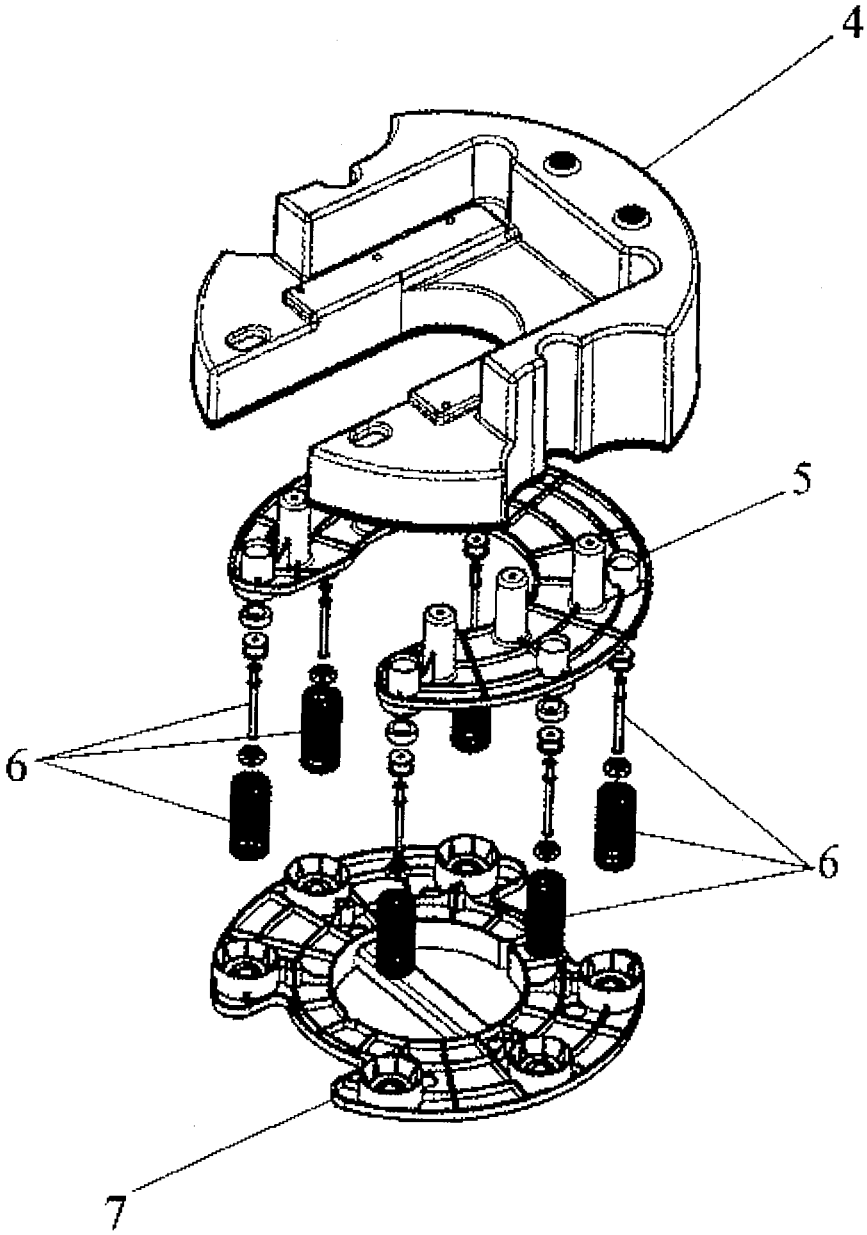
FIG. 2 is an exploded view in perspective of the suspension assembly (1), showing its integrated parts: liquid containing casing (4), upper mobile plate (5), springs and shock absorbers (6) and lower fixed plate (7).

An embodiment of the invention comprises a suspension (1) of a washing machine with a wash group assembly resting on the bottom of the washing machine cabinet (3) by means of the suspension. The suspension provides a lower cushion including plates (5 and 7), shock absorbers (6) and liquid containing casing (4). The shock absorbers (6) may comprise spring and dampener assemblies, as best seen in FIG. 2. This may comprise a coil spring and coaxially arranged rod and piston type dampener, seated within a circular socket of the lower plate, the piston of the dampener being slideable with friction in a corresponding cylinder formed in the upper plate 5.

The cushion or suspension (1) that connects the wash group assembly to the bottom portion of the cabinet (3) is comprised of two parallel plates (5 and 7) connected via the shock absorbers (6).

An upper mobile plate (5) of the cushion is fixed to a transom (11) of the mechanism assembly and another lower one (7) is fixed to the bottom of the cabinet (3). Both plates (5 and 7) are connected via a set of shock absorbers (6) as aforesaid in order to absorb the vibration energy of the washing set (wash group) (2) during the spin cycle, minimizing the transfer of energy to the cabinet (3).

The suspension system (1) includes a liquid containing casing (4) fixed on the upper moving plate (5) of the cushion in order to increase its mass impedance, reducing the accelerations in such portion and serving as a counterweight for the system (e.g., offset motor 8). In an exemplary embodiment, the liquid within the liquid containing casing (4) is, or comprises, water.

Figure 1:
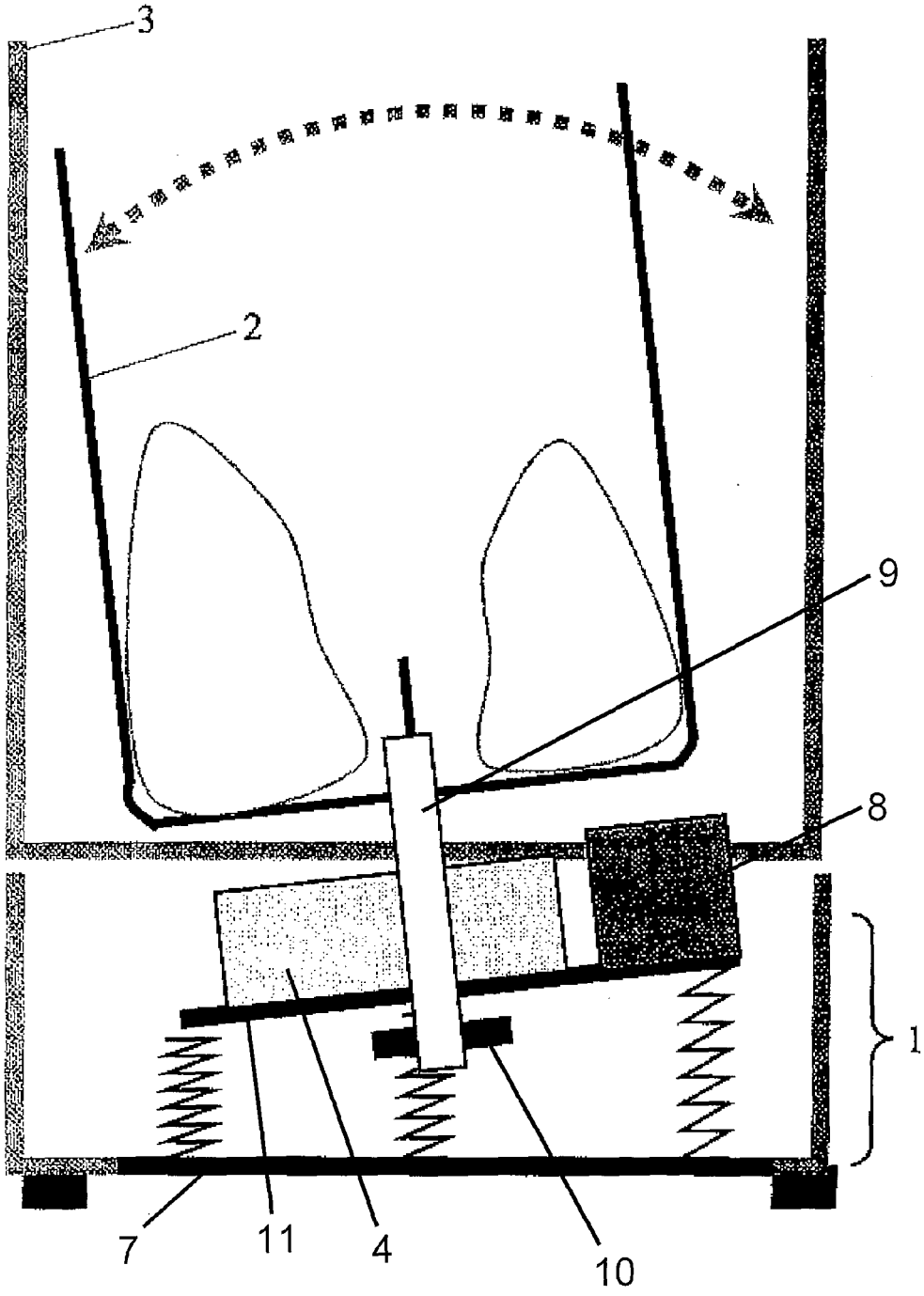
FIG. 1 is a schematic view of the suspension system (1), which suggests the movement of the basket (2) inside the cabinet (3).
Figure 3:
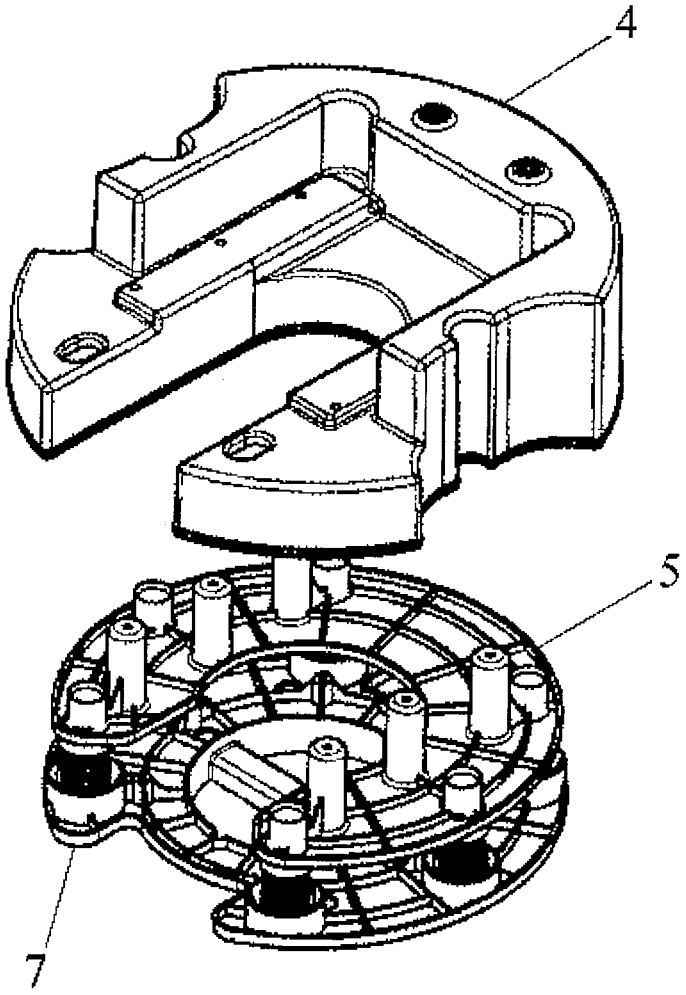
FIG. 3 is an exploded view in perspective of the suspension assembly, including a mounting cushion (with plates 5 and 7) and liquid containing casing (4) separated from the whole.
Figure 4:
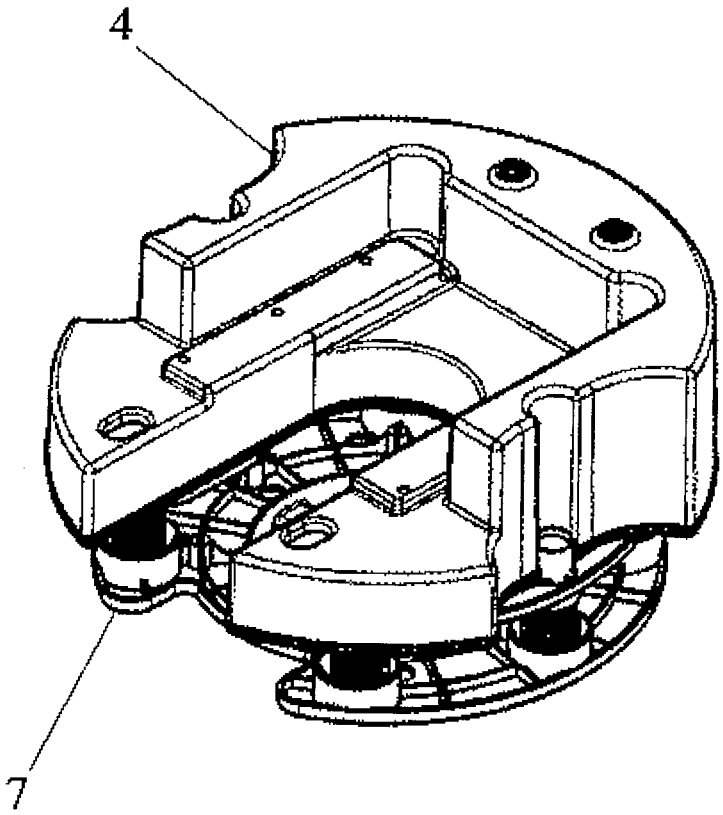
FIG. 4 is an exploded view in perspective of the suspension assembly, including a mounting cushion (with plates 5 and 7) and liquid containing casing (4) separated from the whole.

For a better understanding, the mode of operation of the suspension (1) can be noted in FIG. 1. The bottom cushion or suspension, comprised of the plates (5 and 7), shock absorbers (6) and liquid containing casing (4) connects the washing assembly (2) to the bottom of the cabinet (3). The two parallel plates (5 and 7) are connected by the shock absorbers (6); the liquid containing casing (4) is fixed on the upper moving plate (5) of the cushion, in order to increase its mass impedance. As seen in FIGS. 2-4, the liquid containing casing (4) is generally of a U-shaped configuration and is fixed on the upper moving plate (5) by way of a plurality of posts protruding from the top surface of the upper moving plate (5).

In FIGS. 2, 3 and 4 it can be noted in detail, in a sequence of engagement, the constructive arrangement of the suspension assembly (1) composed of the upper mobile plate (5) of the cushion, fixed to the transom (11) of the mechanism assembly and another lower one (7) fixed to the bottom of the cabinet (3) and the two plates (5 and 7) being connected by a set of shock absorbers (6) as aforesaid. On top of this subassembly is mounted the liquid containing casing (4). As diagrammatically depicted in FIG. 1, the suspended wash group assembly comprises spinning basket (2), a central drive shaft (9) attached to and extending into basket (2). As depicted in FIG. 1, on the lower end of drive shaft (9) is a pulley (10) that is operatively connected with a shaft (not shown) of drive motor (8) through a belt or the like (not shown). The transom (11) of the wash group assembly provides a mounting location for the upper moving plate (5) and attached liquid containing casing (4). Offset from that is a mounting location where drive motor (8) is located.

This invention is not limited to the representations mentioned or illustrated herein, and it has to be comprehended in its wide scope. Many changes and other representations of the innovation will come in mind of those skilled in the art to which this innovation belongs, having the learning benefit presented in previous descriptions and attached drawings. Further, it is to be understood that the innovation is not limited to the specific form disclosed, and that changes and other forms are understood as being included within the scope of the attached claims. Although specific terms are used herein, they are only used in a generic and descriptive form and not for a limiting purpose.

The invention claimed is:

1. A suspension system for a washing machine having a cabinet with a bottom, in combination with a wash group assembly suspendable within the cabinet from the bottom, said wash group assembly including a wash basket, a drive motor and a central drive shaft, said suspension system comprising:

an upper plate fixable to the wash group assembly;

a lower plate fixable to a bottom of the cabinet;

an arrangement of shock absorbers moveably suspending said upper plate on said lower plate; and a liquid containing casing mounted on said upper plate;

wherein a transom of said wash group assembly provides a motor mounting platform and said upper plate is also mounted to said transom such that the liquid containing casing is offset from said motor so as to serve as a counterbalance to the motor.

2. The suspension system wash group assembly combination of claim 1, wherein the liquid contained within the liquid containing casing comprises water.

3. The suspension system wash group assembly combination of claim 2, wherein said liquid containing casing is fixably mounted on said upper plate.

4. The suspension system wash group assembly combination of claim 3, wherein said liquid containing casing is fixably mounted on said upper plate by way of engagement with a plurality of posts protruding from said upper plate.

5. The suspension system wash group assembly combination of claim 2, wherein the liquid containing casing has a generally u-shape so to present an internal void for reception of the central drive shaft.

6. The suspension system wash group assembly combination of claim 1, wherein said liquid containing casing is fixably mounted on said upper plate.

7. The suspension system wash group assembly combination of claim 6, wherein said liquid containing casing is fixably mounted on said upper plate by way of engagement with a plurality of posts protruding from said upper plate.

8. The suspension system wash group assembly combination of claim 1, wherein the liquid containing casing has a generally u-shape so to present an internal void for reception of the central drive shaft.

9. The suspension system wash group assembly combination of claim 1, wherein each of said shock absorbers comprises a spring and dampener.

10. The suspension system wash group assembly combination of claim 9, wherein said spring is a coil spring and said dampener is coaxially arranged with respect to said coil spring.

11. A washing machine, comprising:

a cabinet;

a wash group assembly suspended within the cabinet, said wash group assembly comprising a wash basket, a drive motor and a central drive shaft; and a suspension system comprising:

an upper plate fixed to the wash group assembly;

a lower plate fixed to a bottom of the cabinet;

an arrangement of shock absorbers moveably suspending said upper plate on said lower plate; and a liquid containing casing mounted on said upper plate;

wherein a transom of said wash group assembly provides a motor mounting platform and said upper plate is also mounted to said transom such that the liquid containing casing is offset from said motor so as to serve as a counterbalance to the motor.

12. The washing machine of claim 11, wherein the liquid contained within the liquid containing casing comprises water.

13. The washing machine of claim 12, wherein the liquid containing casing is mounted on said upper plate in at least partially surrounding relation to the central drive shaft of the wash group assembly.

14. The washing machine of claim 12, wherein said liquid containing casing is fixedly mounted on said upper plate.

15. The washing machine of claim 12, wherein said liquid containing casing is fixedly mounted on said upper plate by way of a plurality of posts protruding from said upper plate.

16. The washing machine of claim 11, wherein the liquid containing casing is mounted on said upper plate in at least partially surrounding relation to the central drive shaft of the wash group assembly.

17. The washing machine of claim 11, wherein said liquid containing casing is fixedly mounted on said upper plate.

18. The washing machine of claim 17, wherein said liquid containing casing is fixedly mounted on said upper plate by way of a plurality of posts protruding from said upper plate.

19. The washing machine of claim 11, wherein each of said shock absorbers comprises a spring and dampener.

20. The washing machine of claim 19, wherein said spring is a coil spring and said dampener is coaxially arranged with respect to said coil spring.

* * * * *